US006491153B1

(12) United States Patent
Cassoni et al.

(10) Patent No.: US 6,491,153 B1
(45) Date of Patent: Dec. 10, 2002

(54) DEVICE AND METHOD FOR SPLITTING A PRINTED PRODUCT STREAM

(75) Inventors: Robert Paul Cassoni, Centerville; John Lawrence Herman, Huber Heights, both of OH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/449,133

(22) Filed: Nov. 24, 1999

(51) Int. Cl.[7] ..... B65G 29/00
(52) U.S. Cl. ..... 198/441; 198/601
(58) Field of Search ..... 198/441, 450, 198/598, 601, 611

(56) References Cited

U.S. PATENT DOCUMENTS 3,702,129 A 11/1972 Hawkes et al. ..... 198/180
4,666,031 A * 5/1987 Walker ..... 198/450
5,231,926 A * 8/1993 Williams et al. ..... 198/441 X
5,740,900 A 4/1998 Cote et al. ..... 198/436
5,749,631 A * 5/1998 Williams ..... 198/441
6,170,636 B1 * 1/2001 Een et al. ..... 198/441

* cited by examiner

*Primary Examiner*—James R. Bidwell
(74) *Attorney, Agent, or Firm*—Davidson, Davidson & Kappel, LLC

(57) ABSTRACT

A method for splitting a product stream comprising the steps of delivering a plurality of products to an circular path, transferring a first product of the plurality of products inwardly from the circular path to a first substream, and transferring a second product of the plurality of products inwardly from the circular path to a second substream. Further provided is a device for splitting a product stream comprising a support rotatable about a central axis, the support having an outer circumference and an inner circumference; and at least one transfer device attached to the support for receiving products of the product stream, the transfer device having a first position for receiving a first product of the products at the outer circumference and a second position for delivering the first product to a substream at the inner circumference.

21 Claims, 5 Drawing Sheets

DEVICE AND METHOD FOR SPLITTING A PRINTED PRODUCT STREAM

BACKGROUND OF THE INVENTION

1. Field of the Invention

The present invention relates generally to printing presses and more particularly to a device and method for splitting a stream of printed products.

2. Background Information

Web printing presses print a continuous web of material, such as paper. The continuous web then is cut in a cutting unit so as to form book blocks. These book blocks can be sections of a newspaper, for example. In order to process the book blocks, for example to perform a trimming operation, it is often desirable to slow the product stream. This may be accomplished by splitting the product stream and then to decelerating the resultant split product streams. This often requires a large amount of floor space.

U.S. Pat. No. 3,702,129 describes a mechanical book clamp which can accommodate various book thicknesses. A chain drive can be used to move the clamps along a desired path.

U.S. Pat. No. 5,740,900 discloses an apparatus for splitting a product stream into an A stream and a B stream. The signatures are gripped by grippers, and alternating grippers rotate to split the product stream. This device requires a large amount of floor space to perform the split, and performs only an A/B split.

BRIEF SUMMARY OF THE INVENTION

An object of the present invention is to provide for a device and method for splitting a printed product stream, such that the amount of floor space required for the split is reduced. An additional or alternative object of the present invention is to be able to split the printed product stream into more than two substreams.

The present invention provides a method for splitting a product stream including the steps of delivering a plurality of products to a circular path, transferring a first product of the plurality of products inwardly from the circular path to a first substream, and transferring a second product of the plurality of products inwardly from the circular path to a second substream.

By using the circular path and inward transferring, the splitting can be accomplished in a vary small amount of floor space, i.e. with a small footprint.

A single transfer device may perform both the transferring of the first product and the transferring of the second product. The method also may further comprise transferring a third product of the plurality of products inwardly from the circular path to a third substream and transferring a fourth product inwardly from the circular path to a fourth substream. The first substream, the second substream, the third substream and the fourth substream then may be located in a circular arrangement ninety degrees apart. In such an arrangement, the first product may be received by a transfer device attached to a support and delivered to the first substream after a ninety degree rotation of the support. The transfer device preferably rotates 180 degrees during the ninety degree rotation of the support.

The first and second substreams preferably move downwardly, which permits for a minimum of floor space use.

The present invention also provides a device for splitting a product stream comprising a support rotatable about a central axis, the support having an outer circumference and an inner circumference, and at least one transfer device attached to the support for receiving products of the product stream. The transfer device has a first position for receiving a first product of the products at the outer circumference and a second position for delivering the first product to a substream at the inner circumference.

The at least one transfer device preferably includes four transfer devices. The support may include a hub and four arms extending from the hub. A first of the at least one transfer device preferably is located at an end of one of the four arms, the end being located away from the hub. The support also may include a hub and eight arms. In the second position the transfer device is capable of receiving a second product of the products at the outer circumference.

BRIEF DESCRIPTION OF THE DRAWINGS

Two embodiments of the present invention are described below by reference to the following drawings, in which.

DETAILED DESCRIPTION

Figure 1:
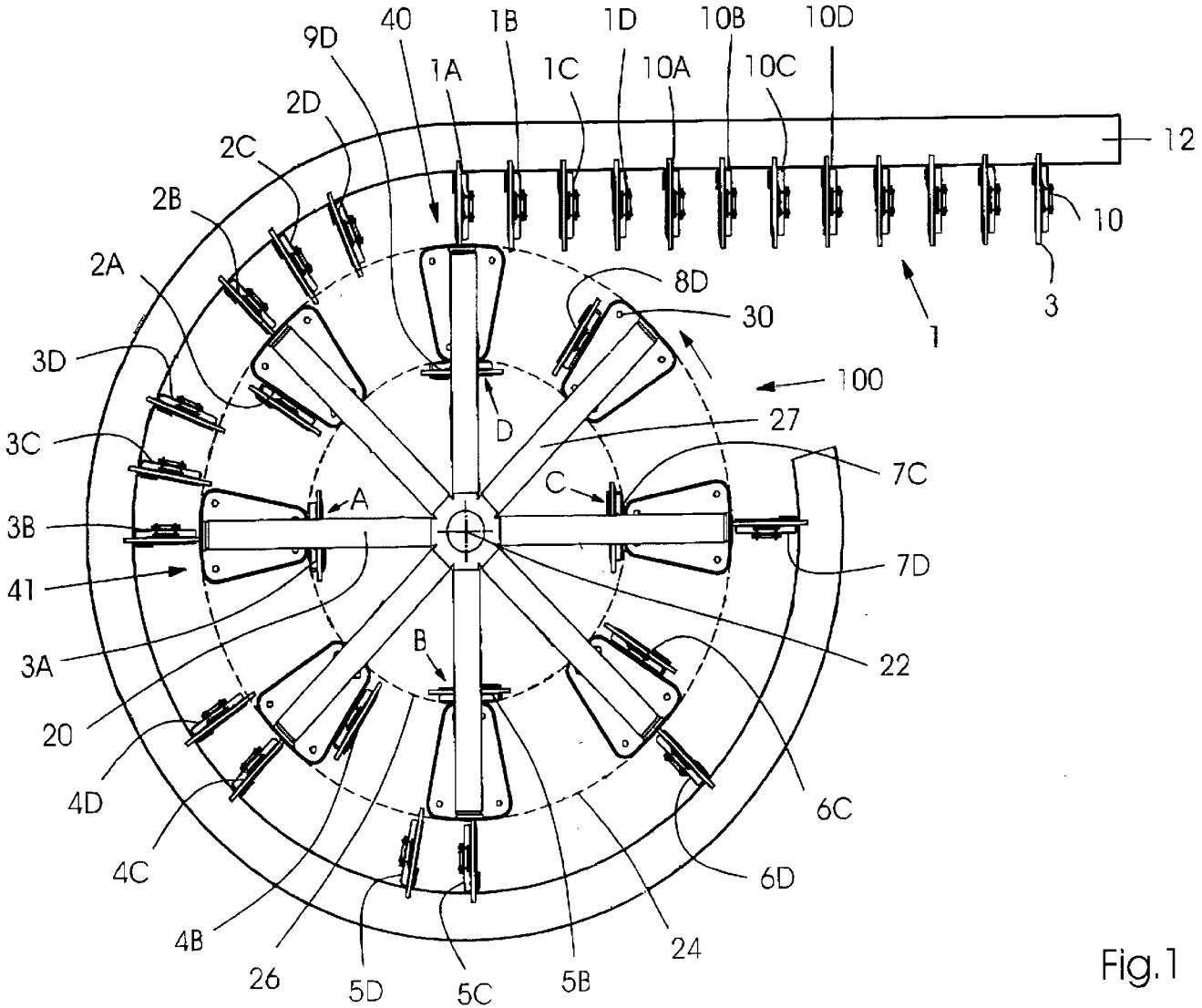
FIG. 1 shows a top view of a first embodiment of the present invention.

FIG. 1 shows a top view of an embodiment of the present invention. A product stream 1 of individual book blocks 3 enters splitting device 100. Each of the book blocks 3 is held in an individual gripper device 10, which is releasably attached on one side to a track 12. The individual gripper devices 10 can be driven in the track by, for example, transport modules moved by a train drive. The individual gripper devices may be the same as those disclosed in the co-pending U.S. patent application Ser. No. 09/448,990 filed on Nov. 24, 1999. This patent application is incorporated by reference herein.

Each of arms 27 of support 20 supports a product transfer device 30. At the 12:00 location of support 20, product transfer device 30 grasps a first gripper device 10 on its side opposite track 12 at outer transfer circumference 24. The gripper device 10 is then released on its track 12 side. As will be described, product transfer device 30 then moves the gripping device 10 inwardly, so that after a ninety degree rotation of the support 20, i.e. the 9:00 position of support 20, the gripping device is moved inner circumference 26 at substream A. This process is repeated by transfer device 30 for three more gripping devices during a full rotation of arm 27.

The embodiment shown in FIG. 1 splits product stream 1 into four downwardly moving (i.e. into the page) product streams at locations A, B, C and D. Splitting device 100 operates as follows:

Support 20 has a velocity at outer circumference 24 slightly slower to that of the velocity of product stream 1. The first of a four product set, for example product 1A of a product set including products 1A, 1B, 1C, and 1D, thus moves against each product transfer device 30 as the product transfer device 30 rotates to a first transfer location 40 . The next product transfer device 30 as it rotates to transfer location 40 picks up the next A product, shown as 10A. The products are spaced and the product speed along track 12 and the velocity of support 20 are timed so that four products pass between each two arms of support 20.

At the 10:30 position, product 2A, which was picked up location 40, has been rotated inwardly by product transfer device 30, but has not yet reached inner transfer circumference 26. Products 2B, 2C and 2D queue behind transfer device 30, but are not yet attached to the transfer device 30.

At the 9:00 position, product 3A has been rotated by product transfer device 30 to the inner transfer circumference, at which point the product or gripper is released and the product moves downwardly into substream A. At the same time, product 3B is accepted by product transfer device 30 at second transfer location 41, while products 3C and 3D remain queued.

At the 7:30 position, product 4B has been moved inwardly by the transfer device 30, while products 4C and 4D queue but are not accepted by the transfer device 30.

At the 6:00 position, product 5B has been moved to inner transfer circumference 26 and is moved downwardly into product substream B. At this time, product 5C is attached to transfer device 30, while product 5D remains queued.

At the 4:30 position, product 6C has been moved partially inward by product transfer device 30, while product 6D queues behind but is not yet attached to product transfer device 30.

At the 3:00 position, product 7C enters products substream C, while product 7D is attached to transfer device 30.

At the 1:30 position, product 8D has been moved partially inwardly by transfer device 30.

At the 12:00 position, product 9D enters the D substream while product 1A is being picked up.

Thus, each arm of support 20 processes four products during a rotation. For example, arm 27 will process move product 1A into the A substream at the 9:00 location, product 1B into the B substream at the 6:00 location, product 1C into the C substream at the 3:00 location and product 1D into the D substream at the 12:00 location as it completes a full rotation. Arm 27 will process products 10A, 10B, 10C and 10D so that they move into substreams A, B, C, and D, respectively.

Advantageously, at each substream A, B, C, D drop off location the relative velocity of the products is zero, i.e. the arm 27 is moving in one direction while the transfer device 30 is moving the product in the opposite direction. This zero velocity makes the transfer of the products to the substream, for example, to a belt, gripper system or other moving device simple.

Although the embodiment of FIG. 1 has been shown with eight arms, it is possible that four arms, two arms, or even one arm could be used to process the products into a plurality of streams.

Figure 2:
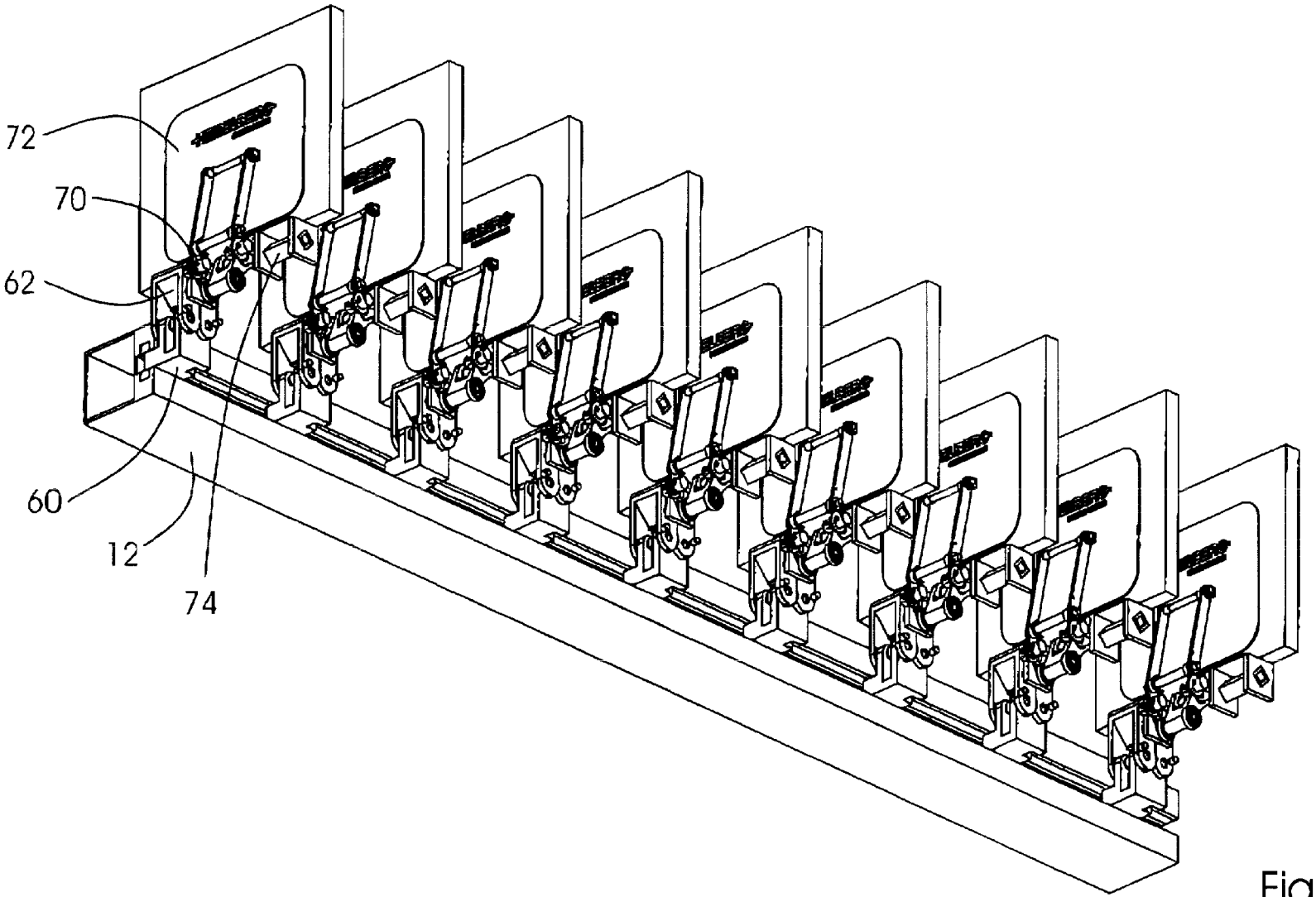
FIG. 2 shows grippers in a chain track.

FIG. 2 shows the track 12 of FIG. 1. Track 12 has movable clamping elements 60 which are attached by a chain so as to move within the track at spaced intervals. Clamping elements 60 have a spring-activated clamp 62, which forms jaws to grip gripping device 70. Gripping device 70 includes a book support 72 which clasps the book block or product. The gripping device 70 has at each side a bar, bar 73 (FIG. 4) and bar 74. Bar 73 may be releasably gripped by transfer device 30, for example through jaws 38 in FIG. 3.

Figure 3:
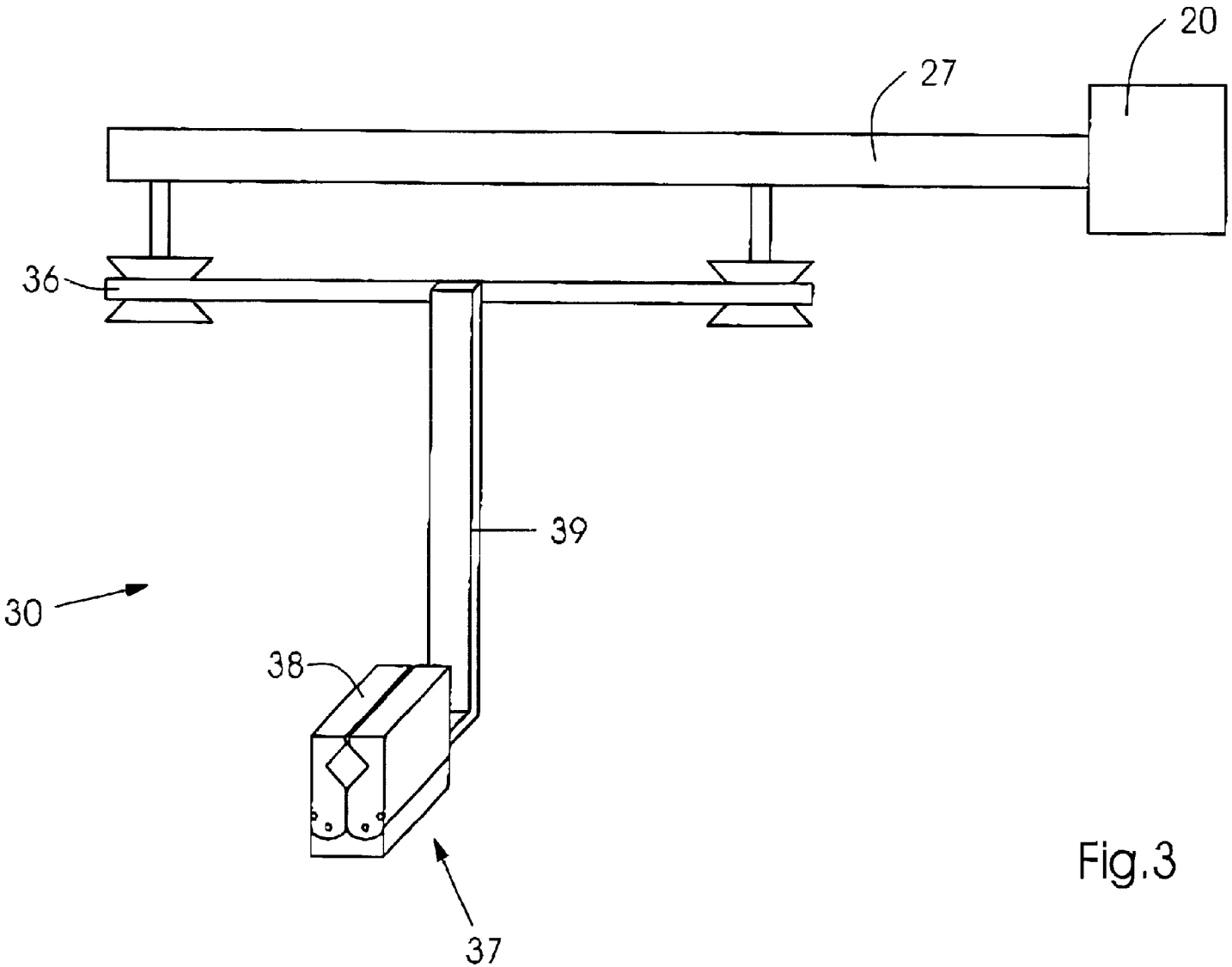
FIG. 3 shows a view of the product transfer device of the present invention.

FIG. 3 depicts the product transfer device 30, which includes a belt or chain drive 36 attached to arm 27 of support 20. Belt or chain drive 36 can be geared to the support 20 so that for each revolution of an arm 27, the belt or chain drive makes two revolutions. Extending downward from belt drive 36 is a transfer gripper 37 having jaws 38 for grasping bar 74 of a gripping device 70 (FIG. 2). Transfer gripper 37 also includes a support arm 39 which holds the jaws so the jaws grasp bar 74 without interfering with a printed product held in a gripping device. Each transfer device actually has two transfer grippers spaced equidistant about the belt of belt drive 36.

After the products are transferred to substreams A, B, C and D (FIG. 1), the jaws can release the gripping device 70 and the gripping device can be further carried in a downward direction, for example, by a belt in an indexable manner.

Figure 4:
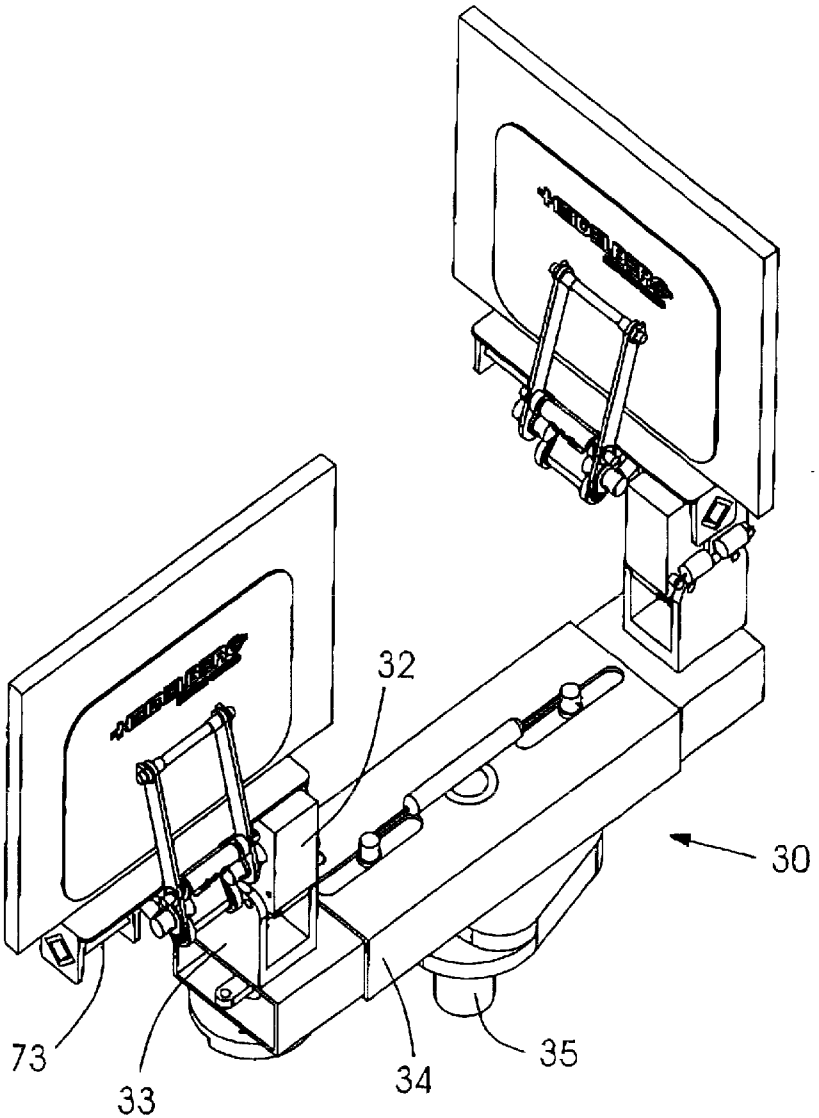
FIG. 4 shows an alternate construction of the product transfer device.

FIG. 4 shows an alternate arrangement for transfer device 30. Transfer device 30 has a clamp 32 which can grasp bar 74 (FIG. 2). Although not visible, bar 73 is first gripped by clamp 62 in FIG. 2, and then released as gripping device 70 is rotated by the transfer device 30. Clamp 32 is supported on a rotatable support 33, which in turn is supported by a rotatable arm 34. A support 35 can be attached to support 20, through for example a plurality of arms.

Figure 5:
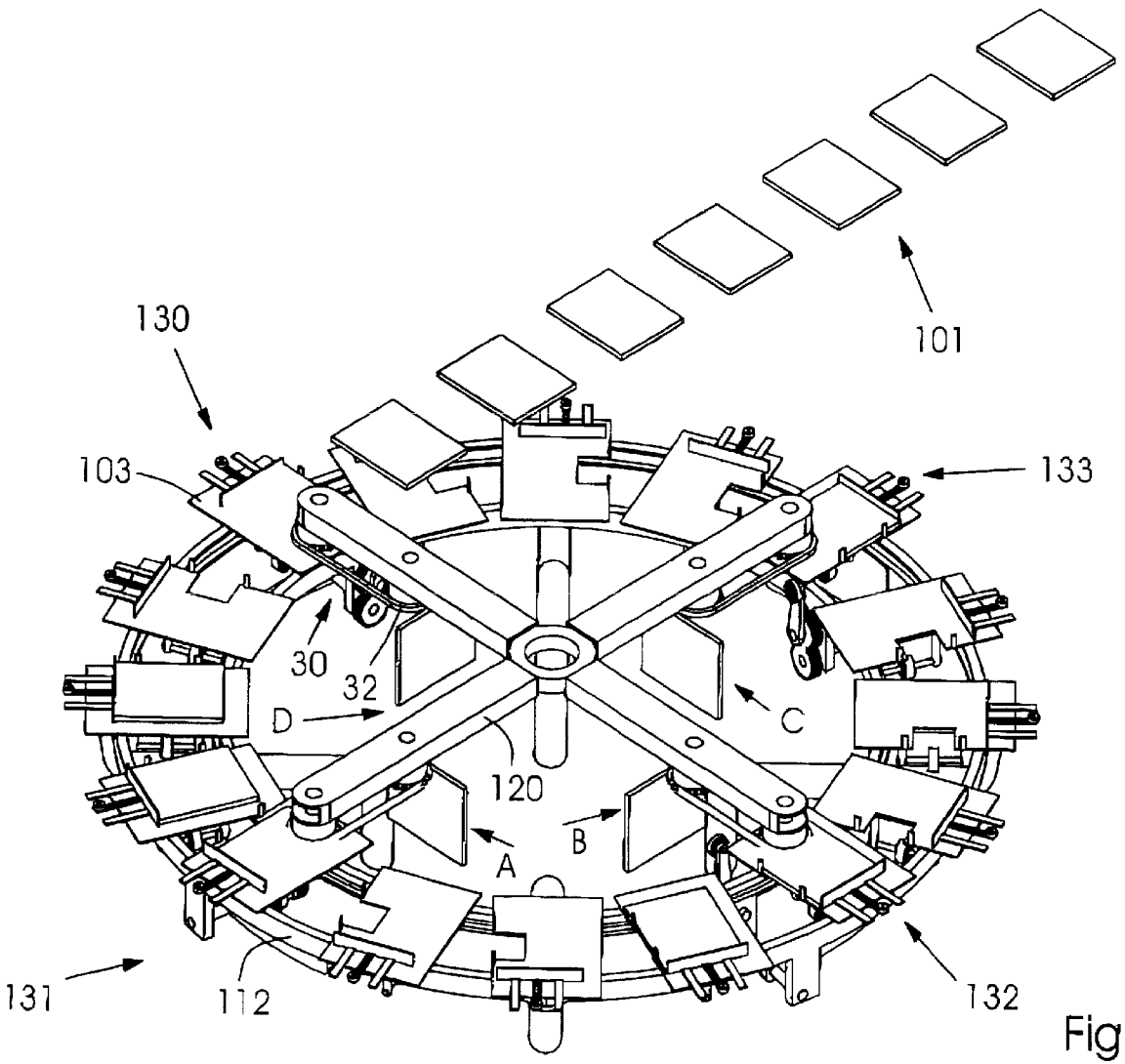
FIG. 5 shows a top perspective view of a first embodiment of the present invention.

FIG. 5 shows an alternate embodiment of the present invention in which gripping devices are not used. A product stream 101 is delivered for example on a conveyer belt to trays 103, which rotate on a track 112. The products are delivered to trays 103 shortly before a 12:00 location 130. A transfer device 30 which has a gripper on a belt 32 then grips the product at 12:00 location 130 and moves the product to an A substream at the 3:00 location 131. At the same time, the transfer device 30 then picks up the next product and transfers the next product to the B substream at 6:00 location 132. At location 132, the next product is picked up of tray 103 by the transfer device 30, which moves this product inwardly to substream C at the 3:00 location 133. At the same time as this product is delivered to substream C, the next product is picked up at location 133 by transfer device 30, and is then moved inwardly to arrive at substream location D when support 120 returns to the 12:00 location 130.

Transport of the products through the substreams and the processing station are further disclosed, for example, in co-pending U.S. patent application Ser. Nos. 09/449,127 and 09/448,986 entitled "High Speed Processing Device for Printed Products" and "Device and Method for Trimming Printed Products" both filed on Nov. 24, 1999. These two applications are also hereby incorporated by reference herein.

"Outer circumference" as defined herein need not be the outermost circumference of the support, but is merely a circumference further away from the center axis than the inner circumference.

What is claimed is:

1. A method for splitting a product stream comprising the steps of:

delivering a plurality of products to a circular path having a first plane;

transferring a first product of the plurality of products inwardly from the circular path to a first substream, the first substream moving perpendicularly to the first plane; and transferring a second product of the plurality of products inwardly from the circular path to the second substream.

2. The method as recited in claim 1 wherein a single transfer device performs both the transferring of the first product and the transferring of the second product.

3. The method as recited in claim 1 wherein the first product is received by a transfer device attached to a support and is delivered to the first substream after a ninety degree rotation of the support.

4. The method as recited in claim 1 wherein the first and second substreams move downwardly.

5. The method as recited in claim 1 further comprising transferring another of the plurality of products inwardly from the circular path to the first substream.

6. The method as recited in claim 1 wherein the first product rotates about a central axis of a support during the transferring of the first product step.

7. The method as recited in claim 6 wherein an outer circumference of the support defines the circular path.

8. The method as recited in claim 1 wherein the delivering step includes conveying products on a flat conveyor belt.

9. The method as recited in claim 1 wherein the delivering step includes conveying products in a gripping device.

10. The method as recited in claim 1 further comprising using a rotating transfer device to transfer the first product inwardly.

11. A method for splitting a product stream comprising the steps of:

delivering a plurality of products to a circular path; transferring a first product of the plurality of products inwardly from the circular path to a first substream; and transferring a second product of the plurality of products inwardly from the circular path to the second substream; transferring a third product of the plurality of products inwardly from the circular path to a third substream and transferring a fourth product inwardly from the circular path to a fourth substream.

12. The method as recited in claim 11 wherein the first substream, the second substream, the third substream and the fourth substream are located in a circular arrangement ninety degrees apart.

13. A method for splitting a product stream comprising the steps of:

delivering a plurality of products to a circular path; transferring a first product of the plurality of products inwardly from the circular path to a first substream; and transferring a second product of the plurality of products inwardly from the circular path to the second substream, the first product being received by a transfer device attached to a support and is delivered to the first substream after a ninety degree rotation of the support, wherein the transfer device rotates 180 degrees during the ninety degree rotation of the support.

14. A device for splitting a product stream comprising:

a support rotatable about a central axis, the support having an outer circumference and an inner circumference; and at least one transfer device attached to the support receiving products of the product stream in a first plane, the transfer device having a first position for receiving a first product of the products at the outer circumference and a second position delivering the first product to a substream perpendicular to the first plane at the inner circumference.

15. The device as recited in claim 14 wherein the at least one transfer device includes four transfer devices.

16. The device as recited in claim 14 wherein the support includes a hub and four arms extending from the hub.

17. The device as recited in claim 16 wherein a first of the at least one transfer device is located at an end of one of the four arms, the end being located away from the hub.

18. The device as recited in claim 14 wherein the support includes a hub and eight arms.

19. A device for splitting a product stream comprising:

a support rotatable about a central axis, the support having an outer circumference and an inner circumference; and at least one transfer device attached to the support for receiving products of the product stream, the transfer device having a first position for receiving a first product of the products at the outer circumference and a second position for delivering the first product to a substream at the inner circumference, wherein in the second position the transfer device is capable of receiving a second product of the products at the outer circumference.

20. A method for splitting a product stream comprising the steps of:

delivering a plurality of products to a circular path; transferring a first product of the plurality of products inwardly from the circular path to a first substream; and transferring a second product of the plurality of products inwardly from the circular path to the second substream;

wherein the first product is received by a transfer device and is delivered to the first substream after a 180 degree rotation of the transfer device.

21. A device for splitting a product stream comprising:

a support rotatable about a central axis, the support having an outer circumference and an inner circumference; and means for transferring products, the means being attached to the support and receiving products of the product stream in a first plane, the transfer device having a first position for receiving a first product of the products at the outer circumference and a second position delivering the first product to a substream perpendicular to the first plane at the inner circumference.

* * * * *

UNITED STATES PATENT AND TRADEMARK OFFICE

CERTIFICATE OF CORRECTION

PATENT NO. : 6,491,153 B1
DATED : December 10, 2002
INVENTOR(S) : Thomas Clinton Hudson It is certified that error appears in the above-identified patent and that said Letters Patent is hereby corrected as shown below:

Column 14,
Line 49, replace “including” with -- defining. --
Line 51, insert -- section -- after “trough.”

Column 15,
Line 6, replace “edge” with -- flange. --

Colum 16,
Line 6, insert -- trough -- after “plenum.”
Line 12, insert -- trough -- after “plenum.”
Line 15, insert -- trough -- after “plenum.”

Signed and Sealed this

Twenty-second Day of April, 2003

JAMES E. ROGAN
*Director of the United States Patent and Trademark Office*